United States Patent [19]

Curletto

[11] Patent Number: 4,884,488

[45] Date of Patent: Dec. 5, 1989

[54] SLENDER HOUSING FOR ELECTRONIC M.I.D.I. ACCORDION

[76] Inventor: Giorgio F. Curletto, 6109 Nevada Ave., NW., Washington, D.C. 20015

[21] Appl. No.: 297,801

[22] Filed: Jan. 13, 1989

[51] Int. Cl.[4] ..... G10D 11/00

[52] U.S. Cl. ..... 84/376 R; D17/3

[58] Field of Search ..... 84/376 R, 376 A, 376 EA, 84/376 K, 376 SM; D17/3, 4, 7

[56] References Cited

U.S. PATENT DOCUMENTS 2,576,480 11/1951 Rieschick ..... 84/376 R 2,826,953 3/1958 Scherer ..... 84/376 K

*Primary Examiner*—L. T. Hix

*Assistant Examiner*—Brian W. Brown

[57] ABSTRACT

A slender housing for electronic M.I.D.I. accordion without bellows and without reeds. It is a fully portable musical instrument which retains two shoulder straps, a bassboard strap, and comprises two separate control panels.

1 Claim, 1 Drawing Sheet

SLENDER HOUSING FOR ELECTRONIC M.I.D.I. ACCORDION

BRIEF SUMMARY OF THE INVENTION

The slender housing for electronic M.I.D.I. (Musical Instrument Digital Interface) accordion is my conceptual idea that stems from an increasing sense of awareness with regard to the discomforts and occupational hardships caused by the heavy weight of the electronic accordion (I am a professional accordionist myself), and the desire, on my part, to find a way to reduce the bulk and the weight of said instrument.

Thanks to the advent of the M.I.D.I., which is also applied to the accordion, the reeds, the reed blocks, the bellows and therefore the right portion of the accordion housing, are no longer indispensable and they become a matter of preference. Now it's possible to choose between a heavy and light electronic accordion. My conceptual innovative idea basically does away with all of the parts no longer indispensable and replaces them with the electronic M.I.D.I. components which can be contained in a far more slender, and therefore lighter, type of housing that connects the left-hand bassboard housing to the right-hand keyboard.

The slender housing for electronic M.I.D.I. accordion retains the traditional shoulder straps and the bassboard strap. It provides two separate control panels. The primary control panel contains all the preset buttons in a single row and runs the full length of the right-hand keyboard's inner edge, and the wider secondary control panel shows in a clear and convenient way the rest of the switches and cursors including a Digital Display Window.

The slender housing for electronic M.I.D.I. accordion can be made out of wood or, for even lighter results, plastic materials can be used.

A BRIEF DESCRIPTION OF THE SEVERAL VIEWS OF THE DRAWINGS

Enclosed are three drawings that I refer to as FIG. 1, FIG. 2, and FIG. 3.

Figure 3:
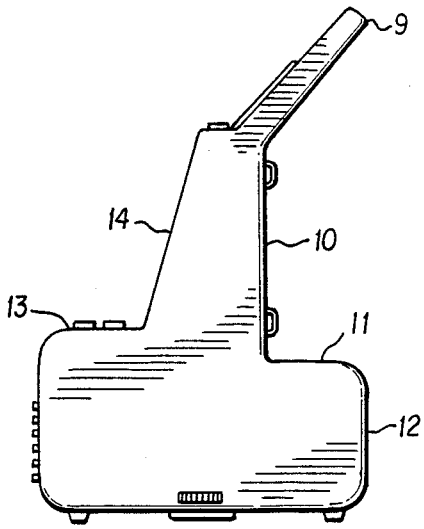

FIG. 3 shows a top view of the slender profile of the instrument and how Part 10 (the central section of the backside of the instrument), located between Part 9 (the outer edge of the backside of the keyboard) and Part 11 (the backside of the bassboard housing), forms an arch designed to allow the instrument to better adhere to the curvature of the performer's body for greater stability and easier handling.

DETAILED DESCRITPION OF THE SLENDER HOUSING FOR ELECTRONIC M.I.D.I. ACCORDION

Figure 1:
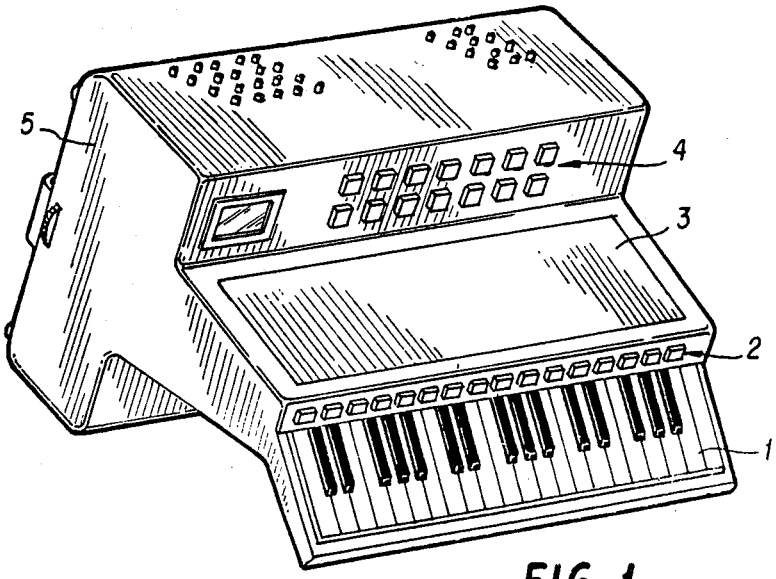
FIG. 1 shows the front view of the instrument including Part 2 and Part 4 (the two M.I.D.I. control panels).
Figure 2:
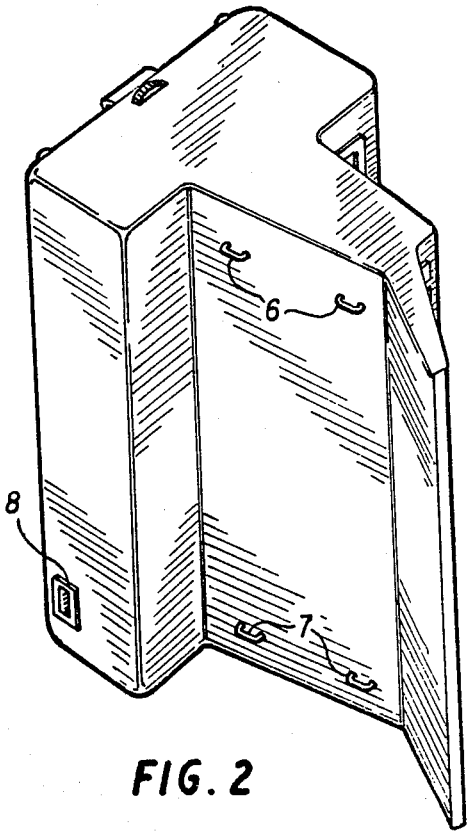
FIG. 2 shows the backside of the instrument where Part 6 and Part 7 (in that order the two top and the two bottom attachments of the shoulder straps) are located and shows Part 8 which is the power cable's connecting plug.

The slender housing for electronic M.I.D.I. accordion retains the standard accordion depth and size of Part 5, FIG. 1 (the portion of the left-hand bassboard housing) and the standard accordion size of Part 1 (the right-hand keyboard), as illustrated in FIG. 1. Part 2, FIG. 1, is the primary control panel where all the preset buttons are arranged in a single row on a narrow, elongated, rectangular surface which faces laterally rightward. Said surface rises lengthwise from the innermost edge of the right-hand keyboard Part 1, FIG. 1, directly forward away from the performer, in a parallel direction with respect to Part 4, FIG. 1 (the secondary control panel) extending itself briefly to a maximum width of ¾" and forming a step by merging lengthwise with the rightmost edge of Part 3, FIG. 1 (the frontal surface of the center section of the slender housing for electronic M.I.D.I. accordion). Said frontal surface consists of one singel removable panel which extends itself obliquely leftward, at approximately 105° angle with respect to Part 2, FIG. 1, and merges lengthwise, at its leftmost edge, with the bottom side of Part 4, FIG. 1 ( the secondary control panel where a larger number of switches and cursors and a digital display window are located). Said secondary control panel rises at approximately 105° angle, lengthwise, with respect to Part 3, FIG. 1 (the center frontal surface of the slender housing for electronic M.I.D.I. accordion), and extends itself in a frontal direction parallel to Part 2, FIG. 1 (the primary control panel), to a width of approximately 3", at which point it merges, lengthwise, with the rightmost edge of the left-hand bassboard surface which is the front section of Part 5, FIG. 1. Part 8 (the main plug for the power cable), as FIG. 2 shows, is positioned in the lower left corner of the back surface of the left-hand bassboard housing. Part 6 and Part 7 (the two top and the two bottom attachments of the shoulder straps are fastened to the backside of the central surface of the slender housing for electronic M.I.D.I. accordion as illustrated in FIG. 2. The degree of angle of Part 10 with respect to Part 11, FIG. 3, should be approximately 90°. Part 14 with respect to Part 13, FIG. 3, should be at a slightly oblique angle of approximately 105°. The degree of angle of the right-hand keyboard (Part 1, FIG. 1) with respect to Part 10, FIG. 3 (the back surface of the center section of the slender housing for electronic M.I.D.I. accordion), should vary according to the individual performer's personal preference. The front portion of Part 5, FIG. 1 (the left-hand bassboard housing), should be somewhat wider than the rear portion of Part 5, FIG. 1 to be able to contain also Part 4 (the secondary control panel) as illustrated in FIG. 1.

I claim:

1. A slender housing for an electronic M.I.D.I. accordion comprising:

a vertical back member having a first and a second longitudinal edge;

a vertically oriented bassboard housing attached to said vertical back member at said first longitudinal edge, said housing having a bassboard facing away from said back member and having a front end;

a vertically oriented keyboard having an inner edge, said inner edge having a front and back side, said keyboard being attached to said second edge of said back member at said back side of said inner edge and facing away from said back member;

a primary control panel in the shape of an elongated narrow member having a first and second longitudinal edge, said primary control panel is disposed adjacent to said keyboard and is attached to said keyboard at said front side of said inner edge of said keyboard;

a center frontal section, said section consists of a single removable panel including two longitudinal edges, said center frontal section is attached by one of its said longitudinal edges to said second longitudinal edge of said primary control panel, said frontal section merges at its other longitudinal edge with an edge of a secondary control panel, said secondary control panel includes a second edge attached to the front end of said bassboard of said bassboard housing.

* * * * *